US005807005A

United States Patent [19]

Wright

[11] Patent Number: 5,807,005

[45] Date of Patent: Sep. 15, 1998

[54] CARTRIDGE LOCKOUT SYSTEM AND METHOD

[75] Inventor: Phillip Byron Wright, Lexington, Ky.

[73] Assignee: Lexmark International, Inc., Lexington, Ky.

[21] Appl. No.: 854,608

[22] Filed: May 12, 1997

[51] Int. Cl.[6] ..... B41J 35/28

[52] U.S. Cl. ..... 400/668; 400/208; 347/214

[58] Field of Search ..... 400/54, 50, 206, 400/208, 208.1, 196, 703, 663, 668; 347/214; 355/260; 395/115

[56] References Cited

U.S. PATENT DOCUMENTS

| | | | |
|---|---|---|---|
| 4,091,913 | 5/1978 | Ku et al. | 400/668 |
| 4,569,608 | 2/1986 | Watanabe | 400/206 |
| 4,611,899 | 9/1986 | Kasamura et al. | 355/3 DD |
| 4,876,956 | 10/1989 | Riley et al. | 400/668 |
| 4,958,192 | 9/1990 | Kusumoto | 355/245 |
| 4,961,088 | 10/1990 | Gilliland et al. | 355/206 |
| 4,963,939 | 10/1990 | Kurando et al. | 355/260 |
| 5,049,904 | 9/1991 | Nakamura et al. | 346/140 R |
| 5,137,379 | 8/1992 | Ukai et al. | 400/121 |
| 5,148,534 | 9/1992 | Comerford | 395/425 |
| 5,184,178 | 2/1993 | Takayanagi et al. | 355/202 |
| 5,184,181 | 2/1993 | Kurando et al. | 355/260 |
| 5,208,631 | 5/1993 | Jacobs et al. | 355/294 |
| 5,224,784 | 7/1993 | Haftmann et al. | 400/208 |
| 5,289,242 | 2/1994 | Christensen et al. | 355/260 |
| 5,383,733 | 1/1995 | Zinsmeyer et al. | 400/208 |
| 5,392,102 | 2/1995 | Toyoizumi et al. | 355/245 |
| 5,430,531 | 7/1995 | Kamiya | 355/260 |
| 5,437,511 | 8/1995 | Halket et al. | 400/668 |
| 5,481,656 | 1/1996 | Wakabayashi et al. | 395/115 |
| 5,486,899 | 1/1996 | Iimori et al. | 355/203 |
| 5,519,422 | 5/1996 | Thoman et al. | 347/49 |
| 5,579,088 | 11/1996 | Ko | 355/260 |
| 5,592,595 | 1/1997 | Wakabayashi et al. | 395/115 |
| 5,596,388 | 1/1997 | Ohkubo et al. | 399/111 |
| 5,630,057 | 5/1997 | Hait | 395/186 |
| 5,659,459 | 8/1997 | Wakabayashi et al. | 395/115 |

*Primary Examiner*—Eugene H. Eickholt
*Attorney, Agent, or Firm*—John J. McArdle, Jr.; Ronald K. Aust; David E. LaRose

[57] ABSTRACT

A cartridge lockout system and method for an image forming apparatus, which includes a cartridge and a wheel rotatably mounted on the cartridge. The wheel has a plurality of digital indicators, each digital indicator being in a first condition or a second condition. A sensor is secured to the image forming apparatus adjacent the digital indicators for sensing the digital indicators and the first and second conditions of the digital indicators and producing a sensor signal during rotation of the wheel. Further included is an engine that has a machine class code and a cartridge support registry data table stored therein. The engine is in electrical communication with the sensor, receives the sensor signal, generates a cartridge class code based on the sensor signal, compares the cartridge class code to the machine class code, and disables operation of the engine if the cartridge class code does not match the machine class code in the cartridge support registry data table.

23 Claims, 2 Drawing Sheets

CARTRIDGE LOCKOUT SYSTEM AND METHOD

BACKGROUND

1. Field of the Invention

The present invention relates to an image forming apparatus and, in particular, relates to a cartridge lockout system and method for an image forming apparatus.

2. Description of the Related Art

In today's highly competitive business climate, an image forming apparatus, such as a laser printer, is sold by manufacturers to a multitude of vendors or Original Equipment Manufacturers (OEMs). Once one of the printers is received by a particular vendor, a unique print cartridge is often installed in the printer, which may or may not be manufactured by the vendor. Many times, the printer will be produced without any manufacturer's brand name so that the vendor can put its own brand name on the printer.

Some vendors require certain unique printer functions that are installed or configured in the printer during the manufacturing process. For example, vendors may require printers to be manufactured with a unique cartridge lockout system and method that prevents another vendor's print cartridge from operating in the printer. For example, if a particular vendor has a print cartridge that prints with magnetic ink, it would be undesirable to print even one check with non-magnetic ink, which would render the check unable to be identified in typical banking operations.

Moreover, it would also be desirable to provide a printer that would not print any pages or images if the printer is not uniquely configured for the installed print cartridge.

SUMMARY OF THE INVENTION

The present invention eliminates the oversights, difficulties, and disadvantages of the prior art by providing a cartridge lockout system and method for an image forming apparatus, such as a laser printer, facsimile machine, or copier, which includes a cartridge and a cartridge indicator device mounted on the cartridge to identify the cartridge. The cartridge indicator device contains a plurality of digital indicators, each digital indicator being in a first condition or a second condition. A sensor is secured to the image forming apparatus preferably adjacent to the digital indicators for sensing the condition of the digital indicators and for producing an output signal associated with the condition of the digital indicators during movement of the cartridge indicator device.

The present invention also provides a printer engine that has a machine class code stored therein as well as a cartridge support registry data table stored therein. The printer engine is in electrical communication with the sensor to receive the sensor signal, generate a cartridge class code based on the sensor signal, compare the cartridge class code to the machine class code, and disable operation of the printer engine if the cartridge class code does not match the machine class code in the cartridge support registry data table.

In one embodiment of the present invention, the cartridge indicator device is a wheel and the plurality of digital indicators are mounted on the periphery of the wheel and sensed by an optical, magnetic, or mechanical sensor.

The present invention further includes a cartridge lockout method that includes the steps of receiving a machine class code stored in a memory of the printer engine and receiving a cartridge class code from the cartridge and comparing the machine and cartridge codes to determine whether the print cartridge can be used for printing. If a print job is pending in the printer and the cartridge class code has not been identified or the machine class code does not match the cartridge class code, a lockout indicator is activated to prevent printing with the cartridge. If the machine class code and the cartridge class code match, a print job is permitted to print if the lockout indicator is inactive. The foregoing process is repeated for the next print job by first determining whether the cartridge class code has been identified.

Other objects, features and advantages of the present invention will become apparent by reference to the following detailed description when considered in conjunction with the accompanying drawings.

DESCRIPTION OF THE PREFERRED EMBODIMENT(S)

Figure 1:
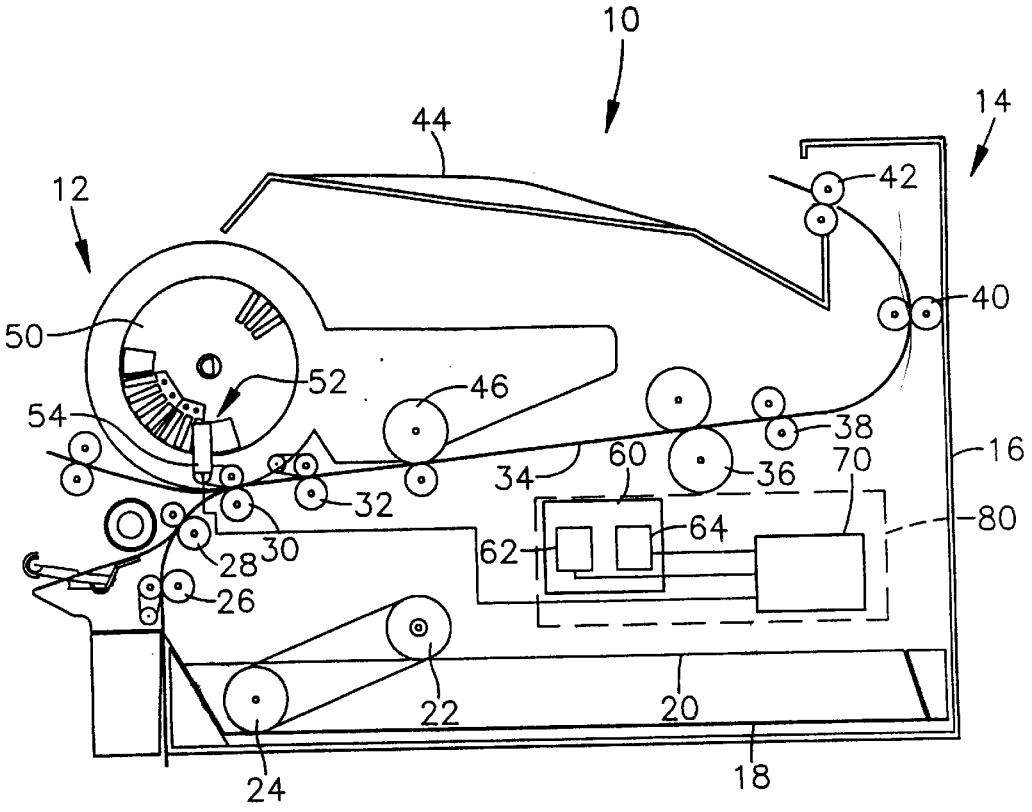
FIG. 1 is a cross-sectional view of an image forming apparatus of the present invention.

Commencing with FIG. 1, a cartridge lockout system 10 for an image forming apparatus 14 is shown. The image forming apparatus 14 can be an electrostatic copier, facsimile machine, or the like, but is preferably an Electro-Photographic (EP) printer. A cartridge 12 of a particular identification, which is preferably a print cartridge, is included in the present system 10. The cartridge 12 is releasably secured in the printer 14 and contains a quantity of ink-based toner for adhering to a stack of papers 20 associated with the printer 14. The printer 14 further includes a rigid, outer-shell housing 16, which includes a paper tray 18 for holding the stack of papers 20. An arcuate paper path 34 formed by paper feed rollers 26, 28, 30 and 32, which are rotatably mounted in the printer 14, provide a paper path 34 through the printer 14.

During operation of printer 14, an individual piece of paper is taken from the stack of papers 20 by a picker roller 24, placed within the paper path 34, and frictionally "grabbed" by paper feed roller 26. Picker roller 24 is driven by motor 22, which is mounted in the printer 14.

A fuser subsystem 36 is included in the printer 14 for thermally bonding the toner, which is deposited from the print cartridge 12 onto each individual piece of paper as it is taken off the stack of papers 20. Prior to the paper reaching the fuser subsystem 36 in the paper path 34, a photo conductive drum 46 carries toner to prepare the paper for the fuser subsystem 36.

After the paper is sent through the fuser subsystem 36, it continues traversing the paper path 34 via paper feed rollers 38, 40, and 42. Printed paper is ejected from the paper path 34 as a stack of printed paper 44 that is collected in an output tray on printer 14.

Figure 2:
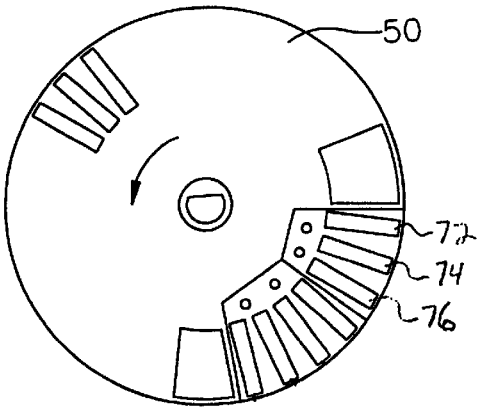
FIG. 2 is a plan view of a cartridge indicator device having a plurality of digital indicators with first and second conditions, of the present invention.

Referring now to FIG. 2, a cartridge indicator device or cartridge wheel 50 containing a plurality of digital indicators or cartridge class codes is illustrated. The wheel 50 provides digital indication of a first condition or second condition, which is preferably provided by covered or uncovered apertures in the wheel. Preferably, the digital indicators include a first window 72, a second window 74, and a third window 76, which represent three binary bits having $2^3$ combinations or 8 bits total. Eight different vendor print cartridges 12 can therefore be represented by a combination of first window 72, second window 74, and third window 76, as shown from Table 1 below:

TABLE 1

| Bit # 210 | Cartridge Class |
|---|---|
| 000 | Lexmark |
| 001 | Generic OEM |
| 010 | Unique A |
| 011 | Unique B |
| 100 | Unique C |
| 101 | Unique D |
| 110 | Universal A |
| 111 | Universal B |

Because the invention provides a method for selecting a unique cartridge class code, a vendor can cover the windows 72, 74, and 76, selectively, to represent a unique cartridge class code for that particular vendor and print cartridge 12. This allows for flexibility and personalization of each vendor's particular print cartridge. The first window 72, second window 74, and third window 76 represent three bits that can equal either a logical "zero" or "one" by uncovering or covering each window, respectively, with a decal during the manufacturing process.

Referring back to FIG. 1, a reader or sensor 52 is shown that could be magnetic, but preferably is optical for reading the class codes. Alternatively, electronic means such as an EEPROM or integrated circuit chip could be mounted on the print cartridge 12 for communication with the printer engine 80 when installed. When the optical sensor 52 is used, the sensor 52 senses the digital indicators by sensing beams of light shining through any of the windows 72, 74, or 76 that may be uncovered. The beams of light are sent by a signal generator 54 that is preferably mounted adjacent to the cartridge wheel 50, but could also be mounted on the wheel 50. The sensor 52 produces a sensor signal during rotation of the cartridge wheel 50. It is preferable to locate the digital indicators or first window 72, second window 74, and third window 76 on the periphery of the cartridge wheel 50, however, they can be mounted on other areas of the printer or cartridge depending upon the application.

The printer 14 includes a printer engine 80 of a particular identification that has a microcontroller 70 for data processing. The printer engine 80 is in electrical communication with the sensor 52. The printer engine 80 includes a circuit board 60, which is mounted in the printer 14. Mounted on circuit board 60 is a flash memory integrated circuit chip 64 that is in electrical communication with the microcontroller 70 that contains a cartridge support registry data table, as will be discussed in further detail below. Further mounted on circuit board 60 is an EEPROM 62, which is preferably a non-volatile RAM, and includes a one byte machine class code stored therein that represents the type of printer 14 produced by the manufacturer. The EEPROM 62 is in electrical communication with the microcontroller 70. The machine class code is read by the printer engine 80 upon each power on sequence of the printer 14. The machine class code is not lost or deleted during power on reset cycles of the printer 14 and has two most significant bits and six least significant bits. The two most significant bits of the machine class code are used to indicate to the printer engine 80 a particular type of lockout and warm-up protocol to implement. A list of available protocols are provided in Table 2 below:

TABLE 2

| Bits 7,6 | Description of lockout and warmup protocol |
|---|---|
| '00' | The printer will print pages while it is gathering the information from the print cartridge. If the Cartridge Class Code is not in the cartridge support Registry data table for the Machine Class of the printer engine, then the printer engine will declare an "invalid Print Cartridge" error. |
| '01' | The printer will not print any pages until it has read the configuration information from the print cartridge. If the Cartridge Class Code is not in the cartridge support Registry data table for the Machine Class of the engine, then the printer engine will declare an "invalid Print Cartridge" error. |
| '10' | Reserved |
| '11' | Reserved |

In operation, the printer engine 80 receives the sensor signal, generates a cartridge class code based on the sensor signal, compares the cartridge class code to the machine class code, and disables operation of the printer engine 80 if the cartridge class code does not match the machine class code located in the cartridge support registry data table stored in the flash memory chip 64. The printer engine 80 also selectively moves the cartridge indicator device or cartridge wheel 50 a set number of rotations per minute. The least six significant bits of the machine class code represent a particular cartridge class within the cartridge support registry data table of the printer engine 80. For example, shown in Table 3 are various cartridge classes with their associated hexadecimal values, which relate to the six least significant bits of the machine class code:

TABLE 3

| Cartridge Class Support Registry | |
|---|---|
| Class # | Hex Value |
| 3 | x'08' |
| 4 | x'10' |
| 5 | x'20' |
| 6 | x'41' |
| 7 | x'81' |

As can be seen from Table 3, machine class code number six is mapped to a hexadecimal value of 41,or binary value of 0100 0001. Thus, the printer engine 80 is notified that cartridge classes 0 and 6 will be supported by the present printer 14 because bits 0 and 6 are the binary value of 1 in the machine class code. Shown in Table 4 below is a sample cartridge support registry data table that links the machine classes with associated cartridge classes:

TABLE 4

| Machine Class # | Cartridge Classes Supported | Resultant Registry Value, bin | Resultant Registry Value, hex | Comment |
|---|---|---|---|---|
| 0 | 0 | 0000 0001 | x'01' | Lexmark. Supports only Lexmark cartridges |
| 1 | 1 | 0000 0010 | x'02' | Generic. Supports only cartridge class b'001' |
| 2 | 2 | 0000 0100 | x'04' | Unique A. Supports only cartridge class b'010' |
| 3 | 3 | 0000 1000 | x'08' | Unique B. Supports only cartridge class b'011' |
| 4 | 4 | 0001 0000 | x'10' | Unique C. Supports only cartridge class b'100' |

TABLE 4-continued

| Machine Class # | Cartridge Classes Supported | Resultant Registry Value, bin | Resultant Registry Value, hex | Comment |
|---|---|---|---|---|
| 5 | 5 | 0010 0000 | x'20' | Unique D. Supports only cartridge class b'101' |
| 6 | 0 & 6 | 0100 0001 | x'41' | Universal A. Supports Lexmark and cartridge class b'110 |
| 7 | 0 & 7 | 1000 0001 | x'81' | Universal B. Supports only Lexmark and cartridge class b'111' |
| 8–63 | Reserved | Reserved | Reserved | Reserved |

Figure 3:
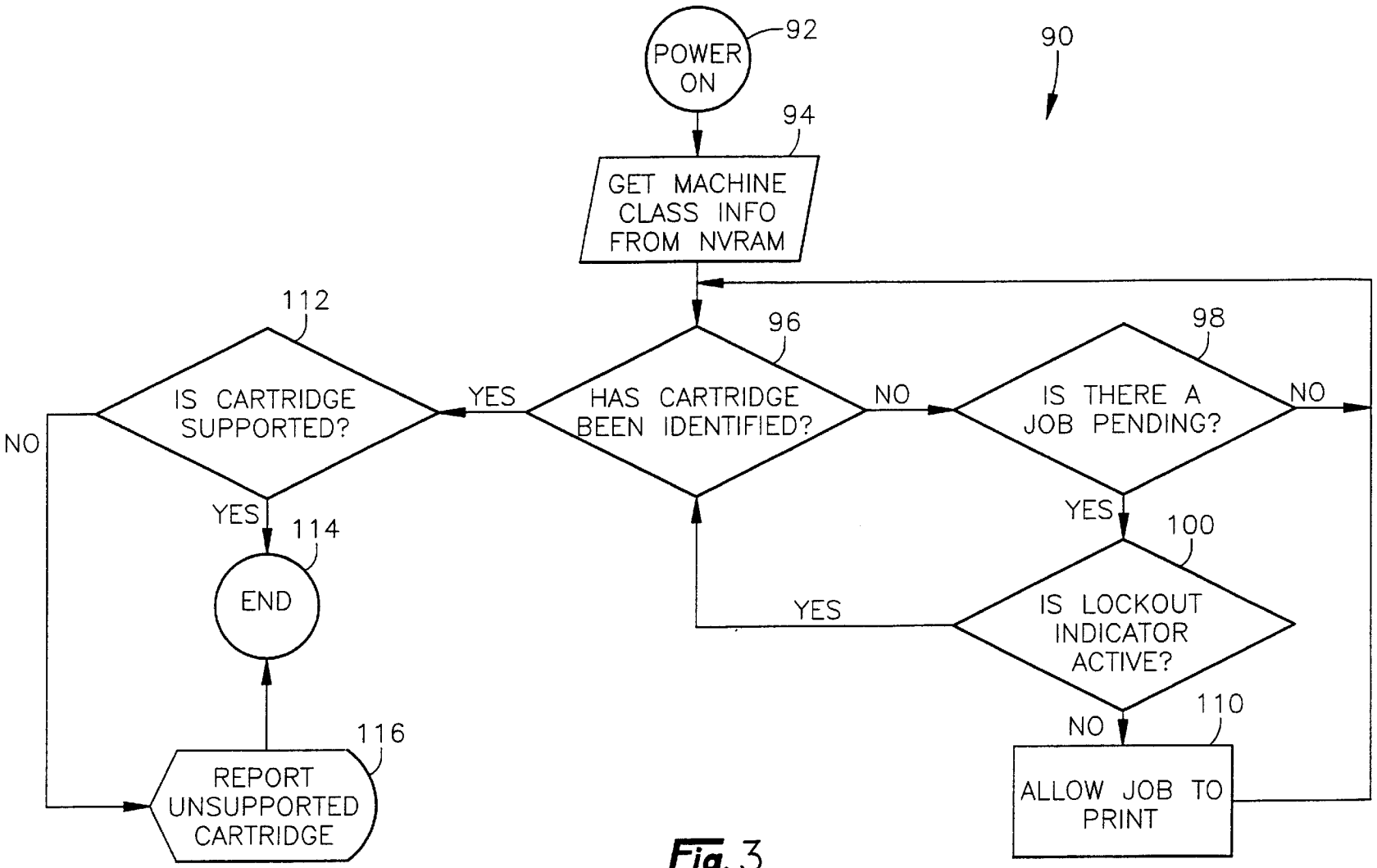
FIG. 3 is a flow chart method of the present invention.

The present invention, as shown in FIG. 3, also includes a cartridge lockout method 90 for the printer 14 that includes a lockout indicator such as a LED disposed on the printer 14. The method 90 begins at circle 92 whereby the printer 14 is powered on. The method 90 next falls to task block 94 whereby the machine class code byte, which is stored in the EEPROM 62 of the printer engine 80, is read by the microcontroller 70. The method 90 next falls to decision block 96 whereby it is determined whether the print cartridge 12 has been identified by the printer engine 80.

To determine the identity of print cartridge 12, the printer engine 80 compares the cartridge class code to the cartridge support registry data table to determine if the particular print cartridge 12 is identified therein. If the answer in decision block 96 is no, the method 90 moves to decision block 98 whereby it is determined whether there is a print job pending in the printer 14. If there is no print job pending in the printer 14, the method reverts back to decision block 96. If, however, it is determined in decision block 96 that the print cartridge 12 is identifiable from the cartridge support registry data table, the method 90 moves to decision block 112 whereby it is determined whether the particular print cartridge 12 is supported. If the print cartridge 12 is supported by the printer engine 80, the method 90 proceeds to circle 114, ending the method, thus allowing the printer 14 to print with the installed cartridge 12. If, however, the print cartridge 12 is not supported, the method falls to task block 116 whereby the printer engine 80 reports that the print cartridge 12 is unsupported and disables operation of the printer engine 80. The method 90 then proceeds to circle 114 to end the method.

Referring back to decision block 98, if it is determined by method 90 that a print job is pending, the method proceeds to decision block 100 whereby it is determined whether the lockout indicator is active. If the printer engine 80 determines that the lockout indicator is active, based on the two most significant bits of the machine class code, the method moves back to decision block 96, whereby it is determined whether the print cartridge 12 has been identified. If, however, it is determined in decision block 100 that the lockout indicator is not active, the method falls to task block 110 and allows the particular print job to print on the printer 14. The method 90 then returns to decision block 96 and the sequence is repeated.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above-mentioned description is to be considered exemplary, rather than limiting, and the true scope of the invention is that defined in the following claims.

What is claimed is:

1. A print cartridge lockout system for an image forming apparatus comprising:

a print cartridge of a particular identification for printing images and having a cartridge indicator device attached thereon, the print cartridge being installed in the image forming apparatus;

a cartridge class code carried by the cartridge indicator device of the print cartridge and corresponding to the particular identification of the print cartridge;

a reader disposed on the image forming apparatus for reading the cartridge class code from the cartridge indicator device and producing a read signal consisting of a series of binary coded bits having at least eight bits comprising at least two most significant bits; and the image forming apparatus having a particular identification for reading the cartridge indicator device, and memory for storing identification information corresponding to the particular identification of the image forming apparatus, and for comparing the cartridge class code and the identification information for determining whether the print cartridge is operable in the image forming apparatus.

2. The system of claim 1 wherein the reader is an optical sensor.

3. The system of claim 1 wherein the reader is a magnetic sensor.

4. The system of claim 1 wherein the print cartridge is a toner cartridge.

5. The system of claim 1 wherein the image forming apparatus is allowed to print while comparing the read signal to the identification information, if the two most significant bits of the identification information are equal to logical zero.

6. The system of claim 1 wherein the reader is in electrical communication with the cartridge indicator device.

7. A cartridge lockout system for an image forming apparatus, the system comprising:

a cartridge releasably secured in the image forming apparatus;

a wheel rotatably mounted on the cartridge, and having a plurality of digital indicators, each digital indicator being in a first condition or a second condition;

a sensor secured to the image forming apparatus adjacent the digital indicators for sensing the digital indicators and the first and second conditions of the digital indicators and producing a sensor signal during rotation of the wheel; and an image forming apparatus engine having a machine class code stored therein, and a cartridge support registry data table stored therein, the image forming apparatus engine being in electrical communication with the sensor, receiving the sensor signal, generating a cartridge class code based on the sensor signal, comparing the cartridge class code to the machine class code and disabling operation of the image forming apparatus engine if the cartridge class code does not match the machine class code in the cartridge support registry data table.

8. The system of claim 7 wherein the cartridge class code is a series of binary coded bits.

9. The system of claim 7 wherein the sensor is an optical sensor.

10. The system of claim 7 wherein the sensor is a magnetic sensor.

11. The system of claim 7 wherein the cartridge is a print cartridge.

12. The system of claim 7 wherein the image forming apparatus is a printer.

13. The system of claim 7 wherein the machine class code consists of eight bits, having two most significant bits and six least significant bits.

14. The system of claim 13 wherein the image forming apparatus engine allows the image forming apparatus to print while comparing the cartridge class code to the machine class code if the two most significant bits of the machine class code are equal to logical zero.

15. The system of claim 7 wherein the digital indicators are disposed on the periphery of the wheel.

16. A cartridge lockout system for an image forming apparatus, the system comprising:

a cartridge releasably secured in the image forming apparatus;

a wheel rotatably mounted on the cartridge, the wheel having a peripheral edge and a plurality of apertures disposed in the peripheral edge;

a sensor secured to the image forming apparatus adjacent the apertures for sensing whether the apertures are covered or uncovered;

an image forming apparatus engine having a machine class code stored therein, the machine class code consists of eight bits, having two most significant bits and six least significant bits, and a cartridge support registry data table stored therein, in electrical communication with the sensor, for receiving electrical signals, of the sensed apertures, from the sensor and converting the electrical signals into a cartridge class code; and whereby the image forming apparatus engine compares the cartridge class code to the machine class code and disables operation of the image forming apparatus if the cartridge class code does not match the machine class code in the cartridge support registry data table, the image forming apparatus engine allowing the image forming apparatus to print while comparing the cartridge class code to the machine class code if the two most significant bits of the machine class code are equal to logical zero.

17. The system of claim 16 wherein the cartridge class code is a series of binary coded bits.

18. The system of claim 16 wherein the sensor is an optical sensor.

19. The system of claim 16 wherein the image forming apparatus is a printer.

20. A print cartridge lockout method for a printer, the method including a lockout indicator and comprising the steps of:

receiving a machine class code stored in memory;

receiving a cartridge class code from the print cartridge;

determining whether the cartridge class code has been identified;

determining whether a print job is pending in the printer if the cartridge class code has not been identified;

determining whether the machine class code matches the cartridge class code;

activating the lockout indicator if the machine class code does not match the cartridge class code;

allowing the print job to print if the lockout indicator is active; and determining whether the cartridge class code has been identified.

21. The method of claim 20 further comprising the steps of:

determining if the print cartridge is supported if the print cartridge has been identified; and reporting an unsupported print cartridge if the print cartridge is not supported.

22. The method of claim 20 further comprising the steps of determining whether the print cartridge and associated cartridge class code have been identified if the lockout indicator is active.

23. The method of claim 20 further comprising the steps of determining whether the print cartridge and associated cartridge class code have been identified if there is no print job pending.

* * * * *